US010309270B2

(12) United States Patent
Boese

(10) Patent No.: US 10,309,270 B2
(45) Date of Patent: Jun. 4, 2019

(54) CAMSHAFT ADJUSTER

(71) Applicant: Schaeffler Technologies AG & Co. KG, Herzogenaurach (DE)

(72) Inventor: Olaf Boese, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 136 days.

(21) Appl. No.: 15/128,067

(22) PCT Filed: Mar. 10, 2015

(86) PCT No.: PCT/DE2015/200135
§ 371 (c)(1),
(2) Date: Sep. 21, 2016

(87) PCT Pub. No.: WO2015/149768
PCT Pub. Date: Oct. 8, 2015

(65) Prior Publication Data

US 2017/0096916 A1 Apr. 6, 2017

(30) Foreign Application Priority Data

Apr. 1, 2014 (DE) ..... 10 2014 206 099

(51) Int. Cl.
*F01L 1/34* (2006.01)
*F01L 1/344* (2006.01)

(52) U.S. Cl.
CPC ... *F01L 1/3442* (2013.01); *F01L 2001/34483* (2013.01); *F01L 2820/041* (2013.01)

(58) Field of Classification Search
CPC ..... F01L 1/3442; F01L 2001/34483; F01L 2820/041
USPC ..... 123/90.15, 90.17
See application file for complete search history.

(56) References Cited

U.S. PATENT DOCUMENTS

| | | | |
|---|---|---|---|
| 6,609,486 | B2 | 8/2003 | Trappe et al. |
| 6,619,248 | B1 | 9/2003 | Bertelshofer |
| 7,987,829 | B2 | 8/2011 | Dupuis et al. |
| 8,166,936 | B2 | 5/2012 | Fujiyoshi |
| 8,261,706 | B2 | 9/2012 | Weiss et al. |
| 8,851,033 | B2 | 10/2014 | Janitschek et al. |
| 8,967,107 | B2 | 3/2015 | Boese |
| 9,074,497 | B2 | 7/2015 | Schulte |
| 2003/0051686 | A1 | 3/2003 | Trappe et al. |

(Continued)

FOREIGN PATENT DOCUMENTS

| | | |
|---|---|---|
| CN | 101835959 | 9/2010 |
| CN | 202047876 | 11/2011 |
| CN | 103216287 | 7/2013 |

(Continued)

*Primary Examiner* — Ching Chang
(74) *Attorney, Agent, or Firm* — Davidson, Davidson & Kappel, LLC

(57) ABSTRACT

A hydraulic, vane-type camshaft adjuster (1) having a rotor (2) and a stator (3) mounted such as to be rotatable relative to each other and to form vanes, wherein, for the radial positioning of the rotor (2) relative to the stator (3), a return spring (5) is or can be secured at one end to the rotor (2) and at the other end to the stator (3), and a spring contact component (15), especially in the shape of a ring, for centering the return spring (5) and/or limiting the radial position thereof, is fixed to the rotor (2) in at least two points.

18 Claims, 7 Drawing Sheets

(56) References Cited

U.S. PATENT DOCUMENTS

| | | | |
|---|---|---|---|
| 2010/0199937 | A1 | 8/2010 | Fujiyoshi et al. |
| 2013/0180483 | A1 | 7/2013 | Weisser et al. |

FOREIGN PATENT DOCUMENTS

| | | | | |
|---|---|---|---|---|
| DE | 102007040017 | | 2/2009 | |
| DE | 102009005114 | A1 | 8/2009 | |
| DE | 102008051732 | A1 | 4/2010 | |
| DE | 102009035233 | | 3/2011 | |
| DE | 102010051052 | A1 | 5/2012 | |
| DE | 102011082590 | A1 | 3/2013 | |
| DE | 102012206567 | | 10/2013 | |
| JP | 2010180862 | | 8/2010 | |
| WO | WO00161154 | | 8/2001 | |
| WO | WO 2009027167 | A1 * | 3/2009 | ..... F01L 1/344 |

* cited by examiner

CAMSHAFT ADJUSTER

The present invention relates to a hydraulic camshaft adjuster of the vane cell type which includes a rotor and a stator which are mounted in such a way that they are rotatable relative to one another and form vane cells, a return spring for radially positioning the rotor relative to the stator being fixed or fixable to the rotor on the one hand and to the stator on the other hand.

BACKGROUND

Camshaft adjusters are used for a targeted adjustment of the phase position between a camshaft and a crankshaft in an internal combustion engine. They allow an optimized setting of valve timing via the engine load and the engine speed. In this way, fuel consumption and exhaust gas emissions may be significantly reduced and the power of the engine may be increased.

A camshaft adjuster is generally made up of a stator, a rotor positioned in the stator, and two sealing covers. A number of pressure chambers, also referred to as vane chambers, are formed in the stator, and are separated from one another by webs which extend radially inwardly away from the stator wall. Rotor vanes of the rotor which is mounted within the stator engage with the pressure chambers. For adjustment of the camshaft, the pressure chambers are acted on by hydraulic medium, as the result of which the rotor is rotated within the stator. Spring elements are often used to move a rotor back into a neutral or starting position during operation of a camshaft adjuster. This requires a secure fastening and position determination of the spring element on the rotor and the stator.

It is known to fasten a coil spring to an inner contour on a spring receptacle, or to needles. However, a spring receptacle is not always usable, for example when a trigger wheel, which is not to be fixedly connected to the camshaft adjuster until the engine is installed, is required. Although fastening to needles is possible in this case, in the individual case it may be necessary to use additional needles, since the coil spring should be relaxed. In this case, problems may arise when a locking mechanism is possibly present, since it is not possible to provide sufficient installation space for the locking mechanism due to the pivot angle of the camshaft adjuster.

A camshaft adjuster of the type mentioned at the outset, which includes a spring element designed as a torsion spring, is known from DE 10 2009 005114 A1. The torsion spring is fastened via its two spring ends to spring retainers provided for this purpose, and is situated between a so-called spring cover plate and the sealing cover, designed as a front cover plate. The spring cover plate is connected to the sealing cover via bolts.

A device for variably setting the timing of gas exchange valves of an internal combustion engine, including a spring element designed as a torsion spring, is known from DE 10 2008 051 732 A1. The torsion spring is situated in a spring chamber, and is fastened via its two spring ends to a sealing cover designed as a side cover. The spring chamber is delimited by a cup-shaped spring cover, for which purpose the spring cover at least partially overlaps the device radially and axially. The spring cover and the sealing cover are fastened to one another via form-fit elements.

DE 10 2010 051 052 A1 provides a camshaft adjuster for an internal combustion engine, including a stator which is connectable to a crankshaft in a rotatably fixed manner, a rotor which is supported in the stator and rotatable about a rotation axis, a sealing cover for minimizing leaks, and a spring element for positioning the rotor with respect to the stator, the spring element being held on the sealing cover via a spring clip in the axial direction and via multiple bolts in the radial direction.

DE 10 2011 082 590 A1 provides a camshaft adjuster which includes a drive element, and an output element which is connectable to a camshaft, and a trigger wheel which is situated coaxially with respect to the rotation axis of the camshaft adjuster, the trigger wheel including a radial tab and an orientation means, the radial tab being provided for fixing the axial position of the trigger wheel with the camshaft adjuster, and the orientation means being provided for fixing the angular position between the trigger wheel and the camshaft.

SUMMARY OF THE INVENTION

Due to their weight and the costs associated with the manufacture and material management, the use of spring covers and/or separate components for axial and radial position determination, positioning, and retaining of return springs does not represent a long-term solution for positioning a spring element on a sealing cover. Using a sufficient number of bolts which are positioned for this purpose at an appropriate location on the camshaft adjuster may result in installation space problems, in particular for camshaft adjusters with locking mechanisms, since situating the bolts in the best suitable positions is not possible, or is possible only with limitations. However, if a trigger wheel is to be situated on the camshaft adjuster, such bolts are often the only option for positioning the return spring.

It is an object of the present invention to provide a camshaft adjuster which does not have the above-mentioned disadvantages, or has them only to a lesser extent. In particular, it should be possible for the return spring to be relaxed via the components used for its positioning and fastening. In addition or alternately, cost-effective manufacture and material management for manufacturing should be possible.

The present invention provides a camshaft adjuster with a spring contact component for centering and/or delimiting the radial position of the return spring is fixed to the rotor at at least two points, and in particular is secured against rotation. Due to this type of spring contact component, a preferably large-surface spring contact for the return spring is provided which is coordinated with the other components and their geometry and configuration relative to one another, via which the return spring may be securely radially and/or axially positioned, retained, and relaxed. The return spring may be relaxed in particular in the radial direction. The camshaft adjuster according to the present invention is particularly suited for control drives, chain drives, and belt drives, in particular in the automotive field.

The stator in the installed state may be connected to a crankshaft in a rotatably fixed manner. The rotor may be connected to a camshaft in a rotatably fixed manner. Provided in the stator are a number of pressure chambers, for example three, four, five, or more pressure chambers, which are also referred to as vane cells and which are separated from one another by webs which extend radially inwardly away from the stator wall. Rotor vanes of the rotor held within the stator engage with the pressure chambers. The torsion angle of the rotor may be delimited by the webs in the stator. A cover is preferably situated in each case on both end-face sides of the camshaft adjuster, for example fixed to the rotor or to the stator, via which the vane cell(s) is/are closed and sealed off. The sealing cover may be designed as a locking cover with a corresponding locking slot. The rotor and stator may be manufactured in particular without cutting. They may be cold-formed, in particular deep-drawn sheet metal components or sheet steel components. Such components are advantageously cost-effective and well suited for mass production. The stator may be designed in particular as a spur gearing component which includes external teeth facing outwardly in the radial direction.

The spring contact component may center the return spring and/or delimit it in the radial position in particular by contact of at least sections of an inner contour of the return spring against or on an outer contour of the spring contact component. The return spring is preferably a coil spring. The inner winding of the return spring rests, at least in sections or parts, preferably with the full surface, against the spring contact component, in particular against the outer contour, and is thus advantageously positioned, retained, and relaxed in the radial direction, even when the spring is deformed.

In one specific embodiment of the present invention, the spring contact component may be provided with a through central opening. The spring contact component preferably has an essentially ring-shaped design as a spring contact ring, or has a ring segment-like design. The material of the spring contact component is preferably plastic or metal, but may be made of other suitable materials or material mixtures. Such a spring contact component is advantageously easy and cost-effective to manufacture, and provides a large-surface support for the return spring.

In one specific embodiment, at least two bolts may be situated on the rotor. A bolt in this sense may in particular be a needle, a peg, a journal, or a pin. The bolt may be fixed to the rotor in an arbitrarily suitable manner, for example screwed in, in particular pressed in. The bolt in each case is preferably situated in parallel to and at a radial distance from the rotation axis of the camshaft adjuster.

According to one specific embodiment, the spring contact component has an opening or recess, in particular a through opening or a through recess. The spring contact component is preferably pressed with this opening or recess onto at least one of the bolts fixed to the rotor, and is positioned axially and radially above same. The spring contact component may be pressed onto multiple or all bolts. It is preferably supported on the rotor in the axial direction. The advantage may thus be achieved that the spring contact component is fixable in both the axial direction and the radial direction in a position-defined manner, and is easily mountable on the camshaft adjuster.

It is advantageous for the spring contact component to have at least one further recess or opening, which may in particular be open radially outwardly. One of the bolts of the rotor engages in each case with the further recess or opening, so that the mentioned further recess or opening is used for angular positioning of the spring contact component relative to the rotor in addition to the positioning via the above-mentioned press joint, and the spring contact component is also advantageously secured against rotation with respect to the rotor. A bolt which engages with the further recess or opening may be guided therein with play (clearance fit) or may be pressed in.

In one specific embodiment, the spring contact component may have a clearance, for example in the form of a recess, groove, or indentation. One end of the return spring designed as a bearing section engages with this clearance. In this way, the return spring is guided relative to the spring contact component in the circumferential direction and positioned in a particularly simple manner. The return spring may be fixed to the spring contact component directly, or directly via a component, for example one of the above-mentioned bolts, which is likewise situated in the clearance. The clearance is preferably at least partially open in the axial direction of the spring contact component so that the return spring may be inserted and mounted in a particularly easy manner.

Axial positioning of the spring contact component at the particular necessary axial distance from the rotor may be achieved particularly easily in that the spring contact component includes contact elements, projections, or overhangs which protrude in the axial direction. For three such contact elements which are circumferentially spaced apart from one another, preferably uniformly spaced apart from one another, the spring contact component is clearly positionally defined with respect to the rotor.

In one specific embodiment, the return spring may be situated radially outside the spring contact component, or in other words, may envelop the spring contact component. The return spring may particularly advantageously rest, at least in sections, against a radially outwardly directed surface of the spring contact component in the circumferential direction. The return spring preferably rests against the spring contact surface in an angular range of approximately 220° to 320°, preferably approximately 240° to approximately 300°, particularly preferably approximately 260° to 280°.

In one specific embodiment of the present invention, the spring contact component may include at least one, preferably three, detent projections which protrude radially into its central opening. A detent projection in this sense may be in particular a snap-fit projection, a tab, or a detent clip. A trigger wheel may be situated on the camshaft adjuster, passing through the central opening with a flange section. The at least one detent projection may be brought into engagement with the trigger wheel and axially fix and position it. It is particularly advantageous that the trigger wheel in this specific embodiment of the present invention may be preassembled in a particularly easy manner, and in the preassembled state is positionally defined in the axial direction and/or in the radial direction.

The trigger wheel, in particular its flange section, may include a contact structure which engages with the detent projection or the detent projections of the spring contact component for a mounted and/or preassembled trigger wheel. The contact structure may be a change in diameter, a shoulder, an undercut, or the like. It is preferably designed as a groove that is introduced in the radial direction. In this sense, a groove is understood in particular to mean an indentation, a notch, or a shoulder. The contact structure, in particular the groove, preferably has a circumferential, in particular an uninterrupted circumferential, design. The at least one detent projection of the trigger wheel engages with the groove. The trigger wheel may thus be axially fixed in a particularly easy manner, while still being rotatable relative to the spring contact component and thus relative to the rotor. The trigger wheel may be preassembled and used as an axial transport- or position-securing means for the return spring.

This trigger wheel may be secured against rotation in particular with the aid of a central screw or central valve which passes through the central opening. The trigger wheel may in particular be clamped between the spring contact component and the central screw. It is pointed out that the component which fixes the trigger wheel on the rotor does not necessarily have to carry out the function of a spring contact component at the same time, and instead may carry out only the function of fixing the trigger wheel, i.e., in general may be referred to as a fastening component.

The at least one detent projection is preferably elastically deformable during installation of the trigger wheel, in particular when the flange section is introduced into the central opening.

In other words, according to the present invention a ring is pressed onto at least one needle or one bolt and is angularly positioned by a second needle. One needle or one bolt or multiple further needles or bolts may be used if necessary. The press fitting may act solely as captive retention and prevent or reduce an uncontrolled change in position, for example oscillation of the ring. The ring may in particular be axially supported on the rotor. The spring preferably engages with a recess in the ring with the aid of a spring hook, and is suspended, indirectly via a needle or a bolt, or directly, on the ring. The ring may contain plastic or metal, and in particular may be made of plastic or metal or a composite. In addition to supporting the return spring, the ring may at the same time be used for fixing a trigger wheel.

In other words, the camshaft adjuster may include a component, preferably a ring, in the area of the trigger wheel fastening, at which tabs protrude into the installation space of the trigger wheel. The tabs are deformed during and due to the installation of the trigger wheel, resulting in a force fit and/or form fit. It is thus possible to insert the trigger wheel into this ring and position and secure the former with the aid of the tabs. The trigger wheel may be held with a force fit and/or form fit and used as an axial transport-securing means when it is installed prior to delivery of the camshaft adjuster.

BRIEF DESCRIPTION OF THE DRAWINGS

The present invention is explained in greater detail below with reference to exemplary embodiments, with the aid of the drawings.

DETAILED DESCRIPTION

Figure 1:
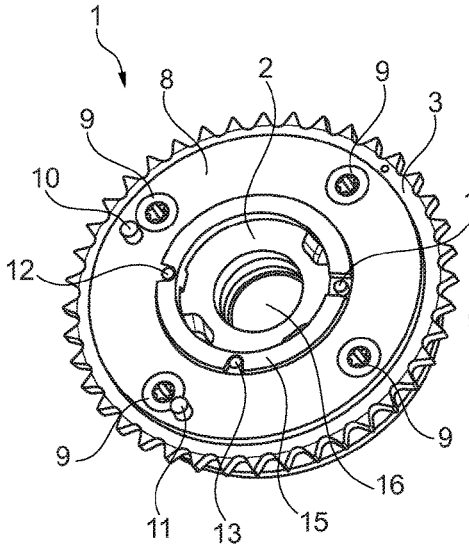
FIG. 1 shows a perspective schematic view of one specific embodiment of a camshaft adjuster according to the present invention.
Figure 2:
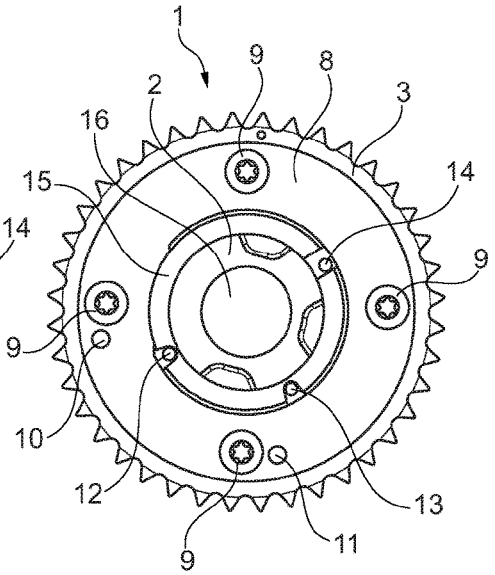
FIG. 2 shows the camshaft adjuster of FIG. 1 in a top view.

The figures are merely schematic, and are used only for an understanding of the present invention. Identical elements are provided with the same reference numerals. Details of the various exemplary embodiments may also be combined and/or exchanged with one another.

FIGS. 1 through 4 show a camshaft adjuster 1 in a first specific embodiment, which is used for adjusting the rotation angle of a camshaft, not shown, with respect to the crankshaft of an internal combustion engine. The gas exchange valves of the internal combustion engine are actuated with the aid of the camshaft. The optimum valve timing changes with the engine speed. For the intake valves, the timing is retarded with increasing engine speed, and for the exhaust valves it is advanced. For engines having separate camshafts for the intake valves and exhaust valves, there is the option of easily achieving the desired speed-dependent adaptation of the timing by appropriately rotating the camshafts. Camshaft adjuster 1 according to the present invention is used for this purpose.

Camshaft adjuster 1 includes a stator 2 and a rotor 3 which are concentrically rotatable about a longitudinal axis 4 of camshaft adjuster 1, and rotatable relative to one another about longitudinal axis 4. Vane cells, not illustrated in the figures, are situated between rotor 2 and stator 3, and are to be acted on by a fluid, for example a liquid such as pressure oil, in order to effectuate a relative rotation of rotor 2 and stator 3.

Camshaft adjuster 1 also includes a return spring 5 in the form of a coil spring. The return spring is fixed to rotor 2 at a first, radially inner end 6 and fixed to stator 3 at a second, radially outer end 7, and pretensions rotor 2 and stator 3 with respect to one another in the rotation direction. In this way, after an adjustment, rotor 2 and stator 3 may be returned to their original relative position with the aid of oil which is introduced into the vane cells in the event of a drop in the oil pressure.

A cover 8 is fastened on the front side of stator 3 with the aid of screw connections 9. The cover is used as a seal for the vane cells formed between rotor 2 and stator 3. A spring retaining bolt 10 is pressed into the front side of cover 8 or stator 3 facing axially away from rotor 2 and stator 3. The spring retaining bolt may also be pressed into stator 3. The spring retaining bolt is enclosed by second end 7 of return spring 5, and fixes this end relative to stator 3. In addition, a spring guide bolt 11, which together with spring retaining bolt 10 fixes radially outer end 7 of return spring 5 in position in the radial direction, is pressed into the mentioned front side of cover 8. Three spring bolts 12, 13, 14 are pressed into rotor 2. The axes of spring bolts 12, 13, 14 of spring guide bolt 11 and of spring retaining bolt 10 are situated in parallel to and at a radial distance from longitudinal axis 4 of camshaft adjuster 1. The angle between spring bolts 12 and 13 and between spring bolts 13 and 14 is approximately 90° in each case, while the angle between spring bolts 12 and 14 is approximately 180°. Spring bolt 14 is enclosed by first end 6 of return spring 4, and fixes this end relative to rotor 2.

Spring bolts 12, 13, 14 are used to fix in position and retain a spring contact component in the form of a spring contact ring 15. In the specific embodiment installed in camshaft adjuster 1 according to FIGS. 1 through 4, the spring contact ring is individually illustrated in various views in FIGS. 5A, 5B, 6A, 6B, and 6C. Spring contact ring 15 has an essentially ring-shaped design with a central opening 16. The spring contact ring has projections 17, 18, 19 which protrude from the plane of the ring in the same axial direction, corresponding to the positions of spring bolts 12, 13, 14. In the area of these projections 17, 18, 19, spring contact ring 15 is provided with recesses 20, 21, 22 in the plane of the ring, which are used to accommodate spring bolts 12, 13, 14. Through holes 23, 24, 25 are introduced into projections 17, 18, 19 in the axial direction, corresponding to the positions of spring bolts 12, 13, 14. As is apparent in FIG. 1, the end faces of projections 17, 18, 19 on the rotor side form stop surfaces which contact and support spring contact ring 15 on rotor 2 in the axial direction.

Figure 6B:
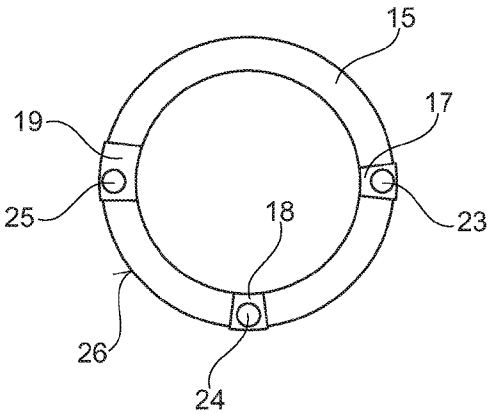
FIGS. 6A, 6B show the spring contact component of FIGS. 3 through 5 in top views from different directions.
Figure 6A:
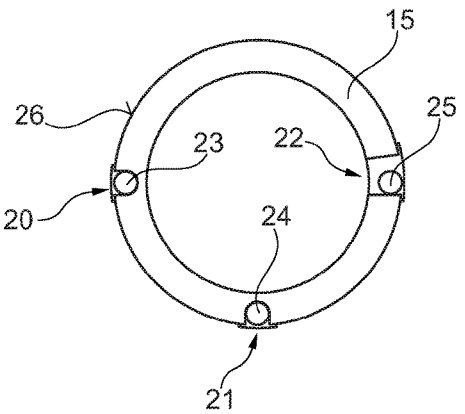
Figure 8:
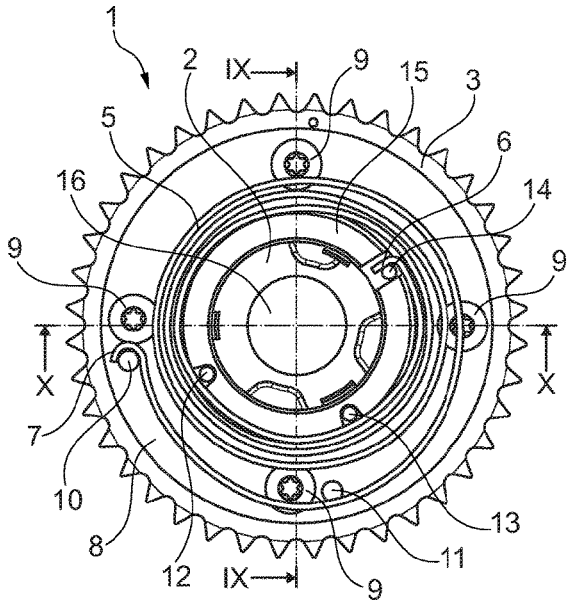
FIG. 8 shows a top view of another specific embodiment of a camshaft adjuster according to the present invention.
Figure 9:
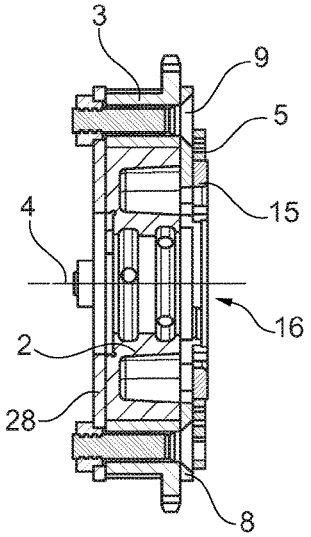
FIG. 9 shows a sectional view along line IX-IX in FIG. 8.
Figure 10:
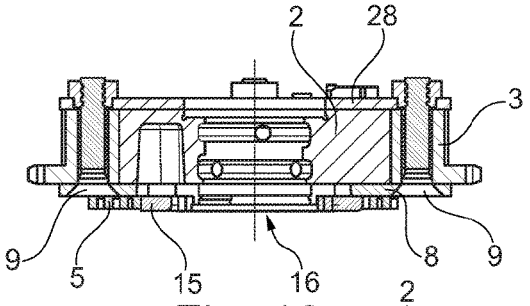
FIG. 10 shows a sectional view along line X-X in FIG. 8.

As is apparent in particular in FIG. 6A, recesses 20 and 21 have approximately the width of through holes 23 and 24 and pass through spring contact ring 15 only partially in the radial direction; i.e., they are designed as radially inwardly closed blind recesses. In addition, recess 22 has the same design as its assigned through hole 25, and protrudes completely through spring contact ring 15 in the radial direction. Laterally adjacent to through hole 25 in the circumferential direction, a free space is formed in which first end 6 of return spring 5 engages with and encloses spring bolt 14.

Spring contact ring 15 is pressed onto spring bolt 14 with the aid of through hole 25, so that the spring contact ring is fixed on rotor 2 to secure the spring bolt against coming loose or being lost. Spring bolts 12 and 13 engage in corresponding through holes 23, 24 with an exact fit, so that spring contact ring 15 is supported at a defined angle with respect to rotor 2.

Figure 3:
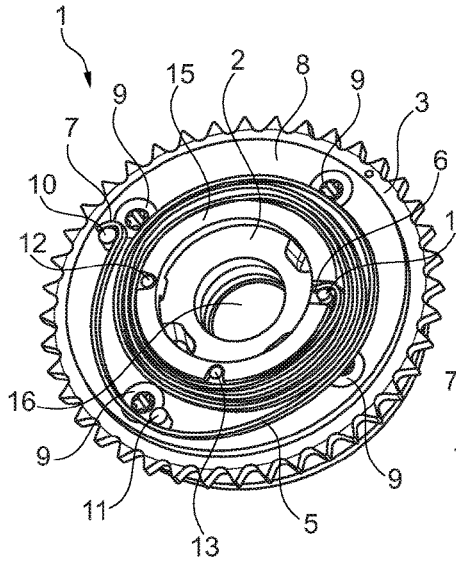
FIG. 3 shows the camshaft adjuster of FIGS. 1 and 2 in a perspective view together with a spring contact component.
Figure 4:
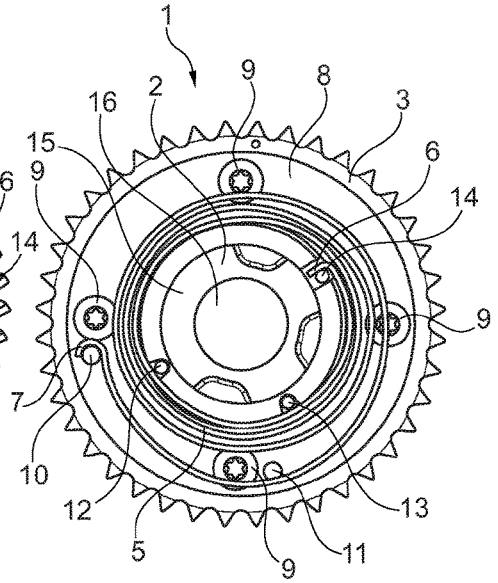
FIG. 4 shows the camshaft adjuster of FIGS. 1 through 3 in a top view together with a spring contact component.
Figure 5B:
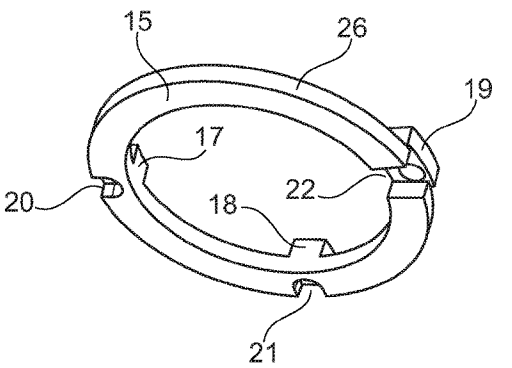
FIGS. 5A, 5B show the spring contact component of FIGS. 3 and 4 in perspective views.
Figure 5A:
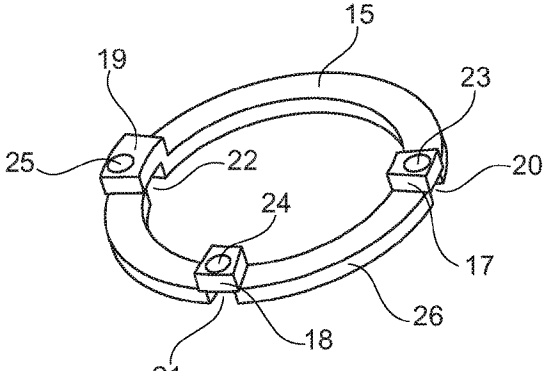
Figure 7:
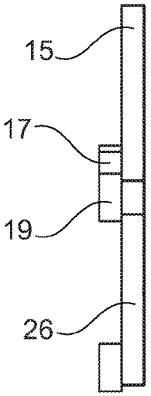
FIG. 7 shows the spring contact component of FIGS. 3 through 6 in a side view.

As shown in particular in FIGS. 3 and 4, spring contact ring 15 is situated radially within return spring 5. Radially outer circumferential surface 26 of the spring contact ring forms a radially outwardly facing contact surface for return spring 5. The radially inner side of the inner winding of return spring 5 rests against the contact surface in an angular range of approximately 200° to 215° in the circumferential direction. The position of return spring 5 with respect to rotor 2, and thus with respect to stator 3, is clearly defined via spring contact ring 15. In addition, return spring 5 is inwardly supported and relaxed over virtually its entire circumference.

FIGS. 8 through 17 show another specific embodiment of a camshaft adjuster 1 according to the present invention, in which a trigger wheel 27 is provided on camshaft adjuster 1. In FIGS. 8 through 12, camshaft adjuster 1 is illustrated without an installed trigger wheel 27, and in FIGS. 13 through 17 is illustrated with an installed trigger wheel 27. With regard to the description of rotor 2, stator 3, return spring 5, cover 8, and spring bolts 10, 11, 12, 13, 14 and the arrangement of spring contact ring 15 thereon, reference is made to the above description of the first specific embodiment. In addition to the mentioned components, the figures for this specific embodiment show a stator cover 28 which is fixed to stator 3 on the side opposite from cover 8, likewise via screw connections 9.

Spring contact ring 15 in this specific embodiment is shown in greater detail in various views and illustrations in FIGS. 18A through 20. A total of three detent projections 30, 31, 32, which protrude radially inwardly into central opening 16 and which may also be referred to as snap-fit projections, are formed on radially inwardly facing circumferential surface 29 opposite from spring contact surface 26. The detent projections are uniformly spaced apart from one another (angular distance 120°) in the circumferential direction, and are inclined toward rotor 2 in the axial direction. Due to their material and/or their geometry, they have spring-elastic properties, as described below.

Figure 11:
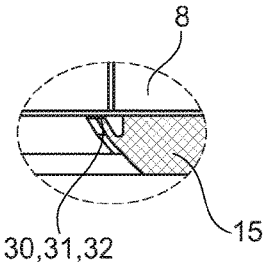
FIG. 11 shows an enlarged detail of FIG. 8.
Figure 12:
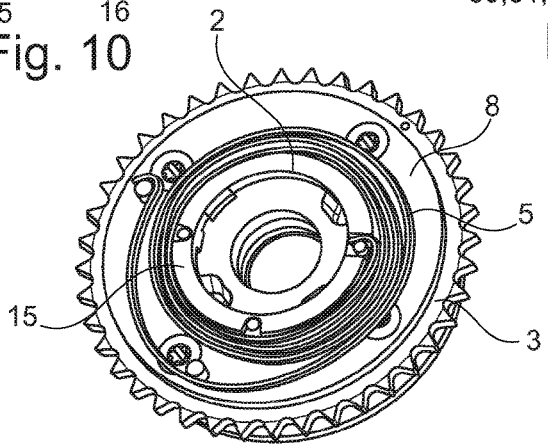
FIG. 12 shows a perspective view of the camshaft adjuster of FIG. 8.
Figure 13:
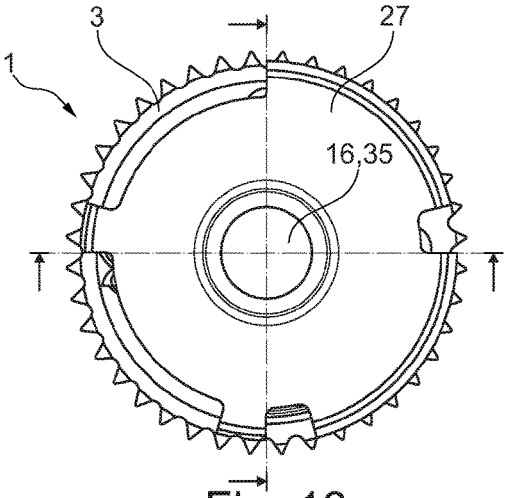
FIG. 13 shows a top view of the camshaft adjuster of FIG. 8 together with a trigger wheel.
Figure 14:
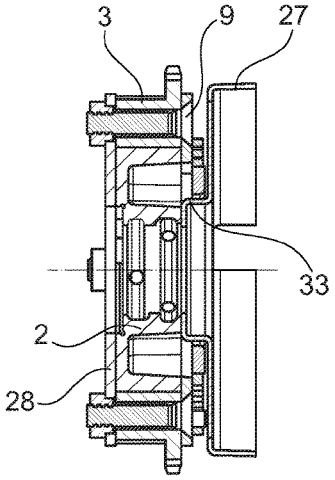
FIG. 14 shows a sectional view along line IX-IX in FIG. 13.
Figure 15:
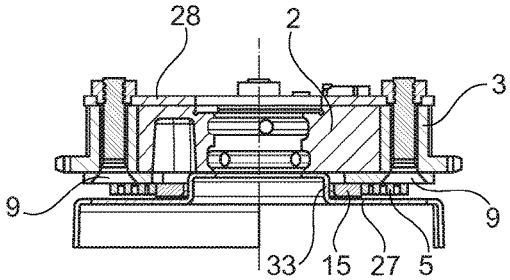
FIG. 15 shows a sectional view along line X-X in FIG. 13.
Figure 16:
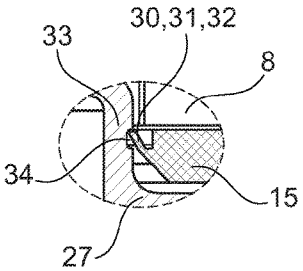
FIG. 16 shows an enlarged detail of FIG. 13.
Figure 17:
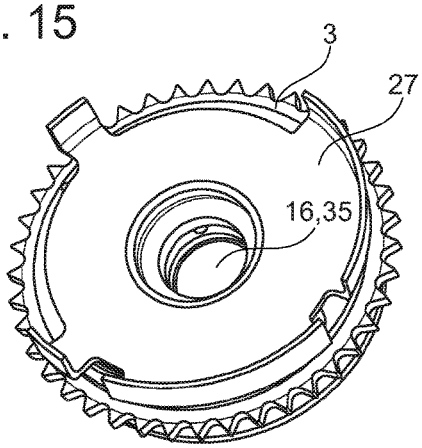
FIG. 17 shows a perspective view of the camshaft adjuster of FIG. 13.
Figure 18A:
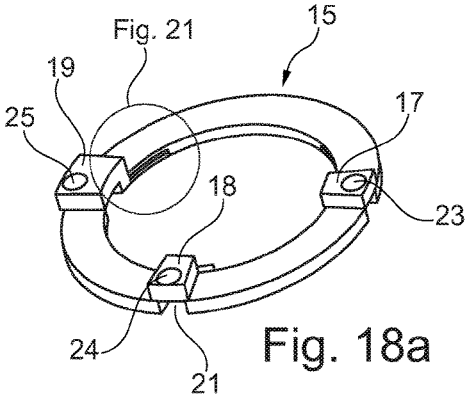
FIGS. 18A, 18B show the spring contact component of FIGS. 8 through 17 in perspective views.
Figure 18B:
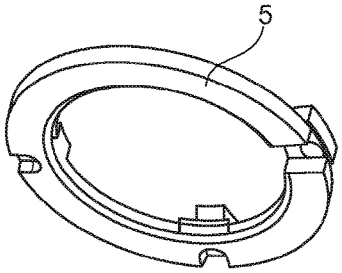
Figure 19A:
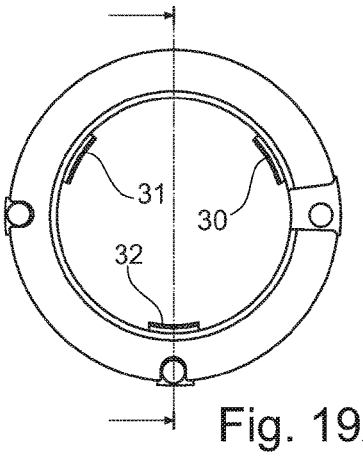
FIGS. 19A, 19B shows the spring contact component of FIGS. 8 through 17 in top views from different directions.
Figure 19B:
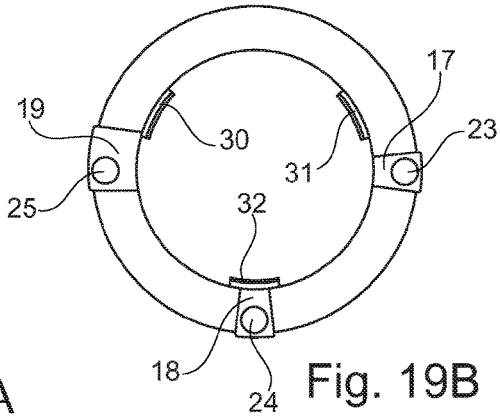
Figure 20:
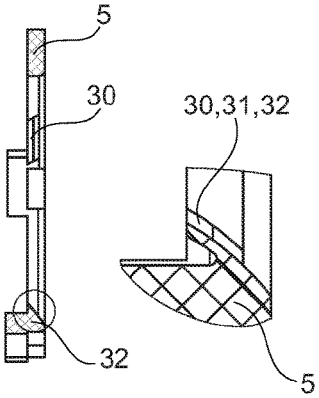
FIG. 20 shows the spring contact component of FIGS. 8 through 17 in a sectional view.
Figure 21:
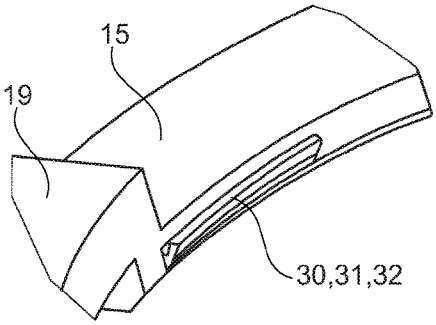
FIG. 21 shows an enlarged detail from FIG. 18A.
Figure 22A:
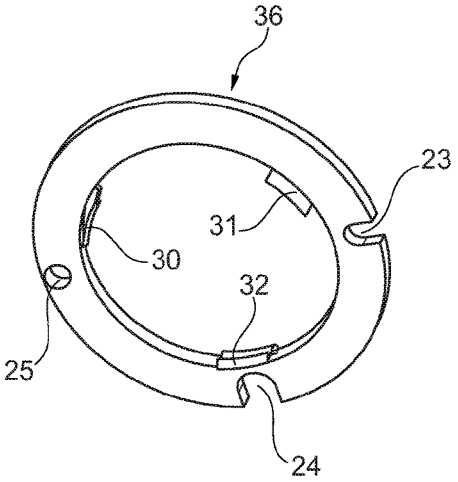
FIGS. 22A, 22B show another specific embodiment of a spring contact component in perspective views.
Figure 22B:
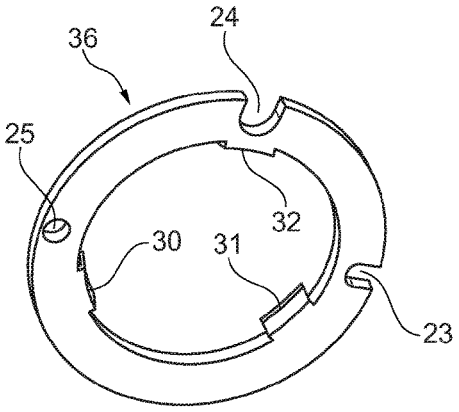
Figure 23:
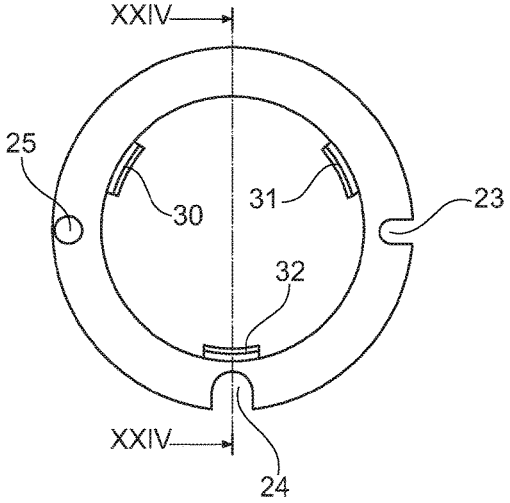
FIG. 23 shows the spring contact component of FIGS. 22A and 22B in a top view.
Figure 24:
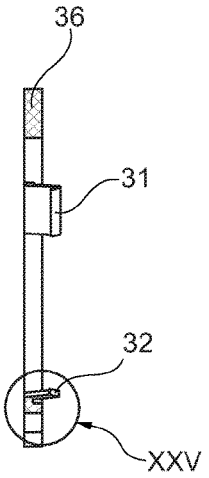
FIG. 24 shows the spring contact component of FIGS. 22 and 23 in a sectional view.
Figure 25:
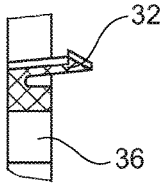
FIG. 25 shows an enlarged detail from FIG. 23.
Figure 26:
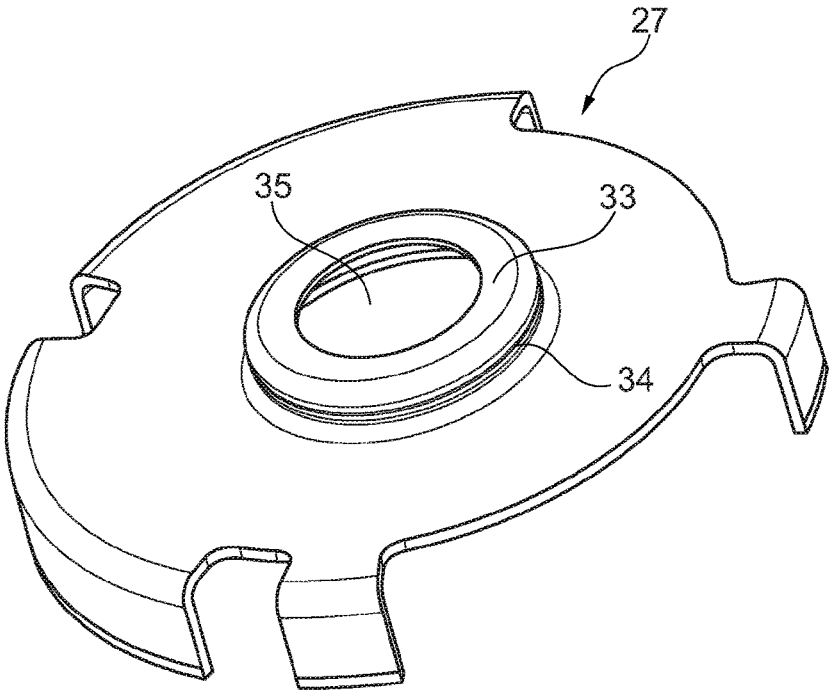
FIG. 26 shows a trigger wheel in a perspective view.

Trigger wheel 27 is shown separately in a perspective view in FIG. 26. Trigger wheel 27 has a plate-shaped design, and includes a hub 33 with a central opening 35. Markings for signal recognition are provided on the outer circumference of trigger wheel 27. A circumferential groove 34 is introduced into the outer circumference of hub 33. Detent projections 30, 31, 32 engage with the groove in a force-fit and/or form-fit manner when trigger wheel 27 is completely installed, so that the axial position of trigger wheel 27 is fixed. The elastic deformation of projections 30, 31, 32 is apparent from a comparison of FIGS. 11 and 16, with FIG. 11 illustrating projections 30, 31, 32 in the undeformed state, i.e., without trigger wheel 27, and FIG. 16 illustrating projections 30, 31, 32 in the deformed state, i.e., engaging with groove 34 in installed trigger wheel 27.

Trigger wheel 27 is fixed and secured on camshaft adjuster 1 in the axial direction due to projections 30, 31, 32 which engage with circumferential groove 34.

FIGS. 22A through 25 show one specific embodiment of a fastening ring 36 for a trigger wheel 27. In this specific embodiment, fastening ring 36 is provided with detent projections 30, 31, 32, but, unlike the two specific embodiments of spring contact ring 15 described above, includes no projections which protrude from the plane of the ring in the axial direction. In this specific embodiment, fastening ring 36 is used only for the arrangement and axial fixing of trigger wheel 27, and does not form a support for return spring 5, which may be supported with the aid of spring bolts 10, 11, 12, 13, 14 when such a ring 36 is used. In other respects, fastening ring 36 is the same as spring contact ring 15 described above, and reference is made to its description.

LIST OF REFERENCE NUMERALS

1 camshaft adjuster
2 rotor
3 stator
4 longitudinal axis
5 return spring
6 first end
7 second end
8 cover
9 screw connections
10 spring retaining bolt
11 spring guide bolt
12 spring bolt
13 spring bolt
14 spring bolt
15 spring contact ring, spring contact component
16 central opening
17 projection
18 projection

19 projection
20 recess
21 recess
22 recess
23 through hole
24 through hole
25 through hole
26 circumferential surface/contact surface
27 trigger wheel
28 stator cover
29 circumferential surface
30 detent projection
31 detent projection
32 detent projection
33 hub
34 circumferential groove
35 central opening
36 fastening ring

What is claimed is:

1. A hydraulic camshaft adjuster comprising:

a rotor;

a stator mounted in such a way that the rotor and stator are rotatable relative to one another and form vane cells, a return spring for radially positioning the rotor relative to the stator being fixable to the rotor on the one hand and to the stator on the other hand, a spring contact component for centering the return spring or limiting a return spring radial position, the spring contact component being fixed to the rotor at two or more points by at least two fasteners, wherein a first end of the return spring engages with and/or encloses one of the at least two fasteners.

2. The hydraulic camshaft adjuster as recited in claim 1 wherein the spring contact component has a through central opening.

3. The hydraulic camshaft adjuster as recited in claim 1 wherein the at least two fasteners are bolts situated on the rotor.

4. The hydraulic camshaft adjuster as recited in claim 1 wherein the spring contact component has at least one recess for angular positioning of the spring contact component relative to the rotor.

5. The hydraulic camshaft adjuster as recited in claim 1 wherein the spring contact component has a clearance with which one end of the return spring designed as a bearing section engages, or with which the spring contact component is supported on the rotor in the axial direction.

6. The hydraulic camshaft adjuster as recited in claim 1 wherein the return spring is situated radially outside the spring contact component, and rests, at least in sections, against a radially outwardly directed surface of the spring contact component in a circumferential direction.

7. The hydraulic camshaft adjuster as recited in claim 1 wherein the spring contact component includes at least one detent projection protruding radially into a central opening of the spring contact component, and a trigger wheel is situated on the hydraulic camshaft adjuster, passing through the central opening with a flange section, the at least one detent projection axially fixing the trigger wheel.

8. The hydraulic camshaft adjuster as recited in claim 7 wherein the trigger wheel has a circumferential groove, introduced in the radial direction, with which the at least one detent projection engages.

9. The hydraulic camshaft adjuster as recited in claim 7 wherein the trigger wheel is secured against rotation with an aid of a central screw passing through the central opening.

10. The hydraulic camshaft adjuster as recited in claim 9 wherein the trigger wheel is clamped between the spring contact component and the central screw.

11. The hydraulic camshaft adjuster as recited in claim 1 wherein a material of the spring contact component is plastic or metal.

12. The hydraulic camshaft adjuster as recited in claim 1 wherein the spring contact component includes projections which protrude from a plane of the spring contact component in a same axial direction, the projections each corresponding to a position of one of the at least two fasteners.

13. The hydraulic camshaft adjuster as recited in claim 1 wherein the spring contact component includes through holes formed in the projections, each of the at least two fasteners passing through one of the through holes.

14. A hydraulic camshaft adjuster comprising:

a rotor;

a stator mounted in such a way that the rotor and stator are rotatable relative to one another and form vane cells, a return spring for radially positioning the rotor relative to the stator being fixable to the rotor on the one hand and to the stator on the other hand, a spring contact component for centering the return spring or limiting a return spring radial position being fixed to the rotor at two or more points, wherein the spring contact component includes at least one detent projection protruding radially into a central opening of the spring contact component, and a trigger wheel is situated on the hydraulic camshaft adjuster, passing through the central opening with a flange section, the at least one detent projection axially fixing the trigger wheel.

15. The hydraulic camshaft adjuster as recited in claim 14 wherein the trigger wheel has a circumferential groove, introduced in a radial direction, with which the at least one detent projection engages.

16. The hydraulic camshaft adjuster as recited in claim 14 wherein the trigger wheel is secured against rotation with an aid of a central screw passing through the central opening.

17. The hydraulic camshaft adjuster as recited in claim 16 wherein the trigger wheel is clamped between the spring contact component and the central screw.

18. A hydraulic camshaft adjuster comprising:

a rotor;

a stator mounted in such a way that the rotor and stator are rotatable relative to one another and form vane cells, a return spring for radially positioning the rotor relative to the stator being fixable to the rotor on the one hand and to the stator on the other hand, a spring contact component for centering the return spring or limiting a return spring radial position, the spring contact component being fixed to the rotor at two or more points by at least two fasteners, wherein the spring contact component includes projections which protrude from a plane of the spring contact component in a same axial direction, the projections each corresponding to a position of one of the at least two fasteners.

* * * * *